US007339464B2

(12) United States Patent
Russell

(10) Patent No.: US 7,339,464 B2
(45) Date of Patent: Mar. 4, 2008

(54) DETECTION-RESISTANT TRANSPONDER WITH "STEALTH PACKAGING" FOR HIGH-RISK SURVEILLANCE APPLICATIONS

(76) Inventor: David Russell, P.O. Box 913, Virginia Beach, VA (US) 23451-0913

( * ) Notice: Subject to any disclaimer, the term of this patent is extended or adjusted under 35 U.S.C. 154(b) by 238 days.

(21) Appl. No.: 11/103,946

(22) Filed: Apr. 12, 2005

(65) Prior Publication Data

US 2008/0018478 A1 Jan. 24, 2008

Related U.S. Application Data

(60) Provisional application No. 60/561,478, filed on Apr. 12, 2004.

(51) Int. Cl.
*G08B 26/00* (2006.01)

(52) U.S. Cl. ..... 340/505; 340/572.1

(58) Field of Classification Search ..... 340/505, 340/572.1, 572.4, 572.8, 539.1, 539.13
See application file for complete search history.

(56) References Cited

U.S. PATENT DOCUMENTS 4,481,428 A * 11/1984 Charlot, Jr. ..... 327/118
4,654,641 A * 3/1987 Ferguson et al. ..... 340/572.2
4,742,357 A * 5/1988 Rackley ..... 342/457
5,032,845 A * 7/1991 Velasco ..... 342/457
5,552,759 A * 9/1996 Stoyka ..... 340/426.33
5,917,423 A * 6/1999 Duvall ..... 340/825.37
6,040,773 A * 3/2000 Vega et al. ..... 340/572.1
6,054,950 A * 4/2000 Fontana ..... 342/463
6,236,836 B1 * 5/2001 Westman et al. ..... 340/7.1
6,239,705 B1 * 5/2001 Glen ..... 340/573.1
6,512,455 B2 * 1/2003 Finn et al. ..... 340/572.1
6,753,782 B2 * 6/2004 Power ..... 340/573.4
6,900,732 B2 * 5/2005 Richards ..... 340/573.1
6,958,697 B2 * 10/2005 Morello et al. ..... 340/572.1
6,988,026 B2 * 1/2006 Breed et al. ..... 701/29
7,015,809 B1 * 3/2006 Sayers et al. ..... 340/539.1
7,138,914 B2 * 11/2006 Culpepper et al. ..... 340/539.13
2003/0090435 A1 * 5/2003 Santhoff et al. ..... 343/893
2004/0057500 A1 * 3/2004 Balachandran et al. ..... 375/138

* cited by examiner

*Primary Examiner*—John Tweel, Jr.

(57) ABSTRACT

An easily deployed, extremely detection-resistant surveillance method, apparatus, and system are disclosed. Preferred embodiments of the apparatus are adapted for generating and broadcasting pulsed transmissions optimized for electronic tagging, tracking, and "homing" applications. This makes the invention excellent for radio-locating "terrorists", criminal suspects, vehicles, and etc., under surveillance. The apparatus is well adapted for "high-risk surveillance targets", where avoiding sophisticated surveillance detection is paramount. The invention uses nondescript "stealth packaging" in various preferred form-factors, that can appear, e.g., to be either a protruding bolt-head, a gas-cap, a wheel-balancing lug, or other nondescript automotive or truck part (depending on embodiment). The preferred signal transmission method uses ultra-low power, pulsed transmissions which are generated and encrypted prior to transmission, using (either proprietary or non-proprietary) spread spectrum signal algorithm-based transmission schemes, or other transmission schemes. Very-low-noise signal detection circuits in a base station receive and decrypt signals, to complete the system.

3 Claims, 1 Drawing Sheet

Figure 1:
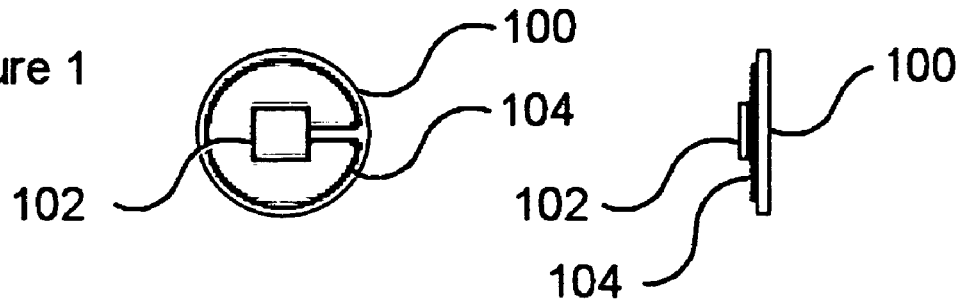
Figure 2:
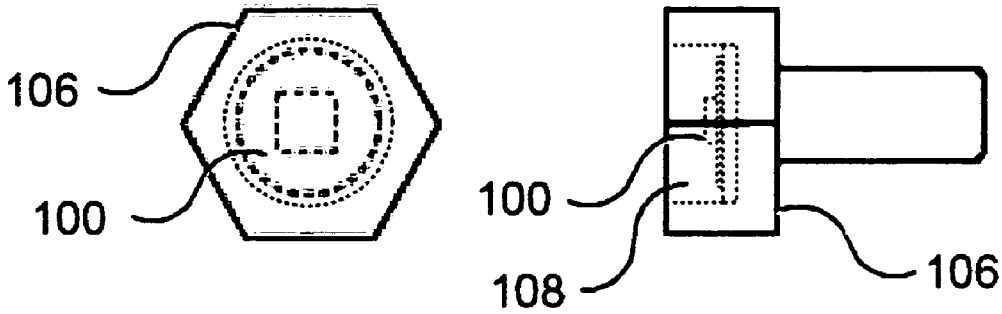
Figure 3:
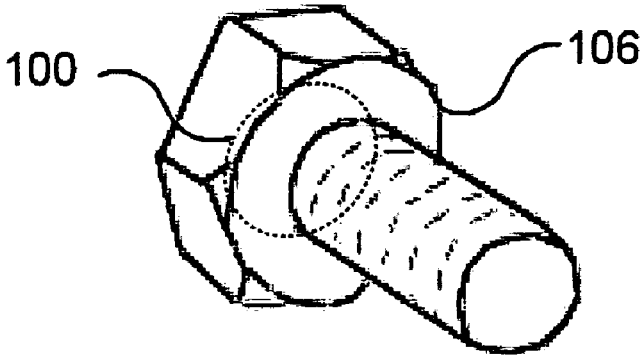

DETECTION-RESISTANT TRANSPONDER WITH "STEALTH PACKAGING" FOR HIGH-RISK SURVEILLANCE APPLICATIONS

CROSS REFERENCE TO RELATED APPLICATIONS

This Application claims the benefit of priority to Provisional Patent Application 60/561,478 which was filed Apr. 12, 2004.

FIELD OF THE INVENTION

The field of the invention is ultra-low-power transponders, more particularly, pulsed transmission transponders using spread spectrum transmission methods and other transmission methods, which are adapted for use in clandestine surveillance operations by means of "stealth packaging".

BACKGROUND OF THE INVENTION

Transponders of many shapes, styles, form-factors, and costs are well known in the art. Many of the earliest transponders were primarily deployed for military tracking applications, such as IFF (interrogative friend or foe) applications other target-monitoring applications. Commercial transponders (often used for security-oriented applications and/or for presence-monitoring applications) are also well known in the art.

Many of the earliest commercial security-oriented and/or presence-monitoring applications—i.e., "presence detection application systems"—use a frequency divider as an electronic tag in typical "anti-shoplifting" commercial transponder applications. Such systems typically include (1) a transmitter for transmitting a scanning signal at a first frequency in a surveillance zone; (2) an electronic tag including an active frequency divider for detecting electromagnetic radiation at the first frequency and for transmitting a presence signal in response thereto at a second frequency that is a sub-multiple of the first frequency; and (3) a receiver for detecting electromagnetic radiation at the second frequency to thereby detect the presence of the electronic tag in a "surveillance zone". In such applications, the electronic tags are attached to articles of which detection is desired, to enable surveillance/detection of the presence of such articles, usually at fixed "surveillance zones". Such presence detection systems are proven highly useful for controlling flows of tagged items past "choke points", e.g., for detecting shoplifting at ingress/egress points at department stores, high-security areas, etc.

A few examples of other related applications include: (1) detecting the presence of a person or vehicle carrying an electronic tag in a surveillance zone (e.g., automatic payment systems for toll booths); (2) detecting the presence of articles bearing electronic tags within a surveillance zone along an assembly line (inventory monitoring, management, and control); (3) detecting the presence of keys attached to electronic tags in a surveillance zone at the exit of an area from which such keys are not to be removed (high security checkpoints), etc. For any of these implementations, the electronic tags can be encased in small card-shaped, snap-shaped, "vice-grip"-shaped, or other form factor electronic packages (such as "removably attachable" devices) that can be attached to a target article in such a manner that the tag cannot be removed from the article without a special tool.

When used in a shoplifting detection system application, e.g., a sales clerk uses such a special tool to remove the electronic tag from merchandise that is paid for. The surveillance zone is located near the doorway, to enable detection of articles from which the electronic tags have not been removed. Some such applications include complex frequency dividers that must be powered by expensive long-life miniature batteries. Other prior art frequency dividers also use either a battery or an external power supply. Most such presence detection systems are neither small, nor portable, nor low in cost.

RELATED ART

U.S. Pat. No. 4,481,428 to Charlot discloses a frequency divider that may be operated without a battery or any external power supply and is suited for use as a transponder in a presence detection system. Such frequency divider includes a first circuit that is resonant at a first frequency for receiving electromagnetic radiation at the first frequency; a second circuit that is resonant at a second frequency that is a sub-harmonic of the first frequency for transmitting electromagnetic radiation at the second frequency; and a semiconductor switching device having gain coupling in the first and second circuits for causing the second circuit to transmit electromagnetic radiation at the second frequency solely in response to unrectified energy at the first frequency provided in the first circuit upon receipt of electromagnetic radiation at the first frequency. The disadvantage of this system is that is it fairly costly and complex, nor it is portable, nor is it conducive to use for clandestine surveillance operations.

U.S. Pat. No. 4,654,641 to Ferguson discloses a battery-less, portable, frequency divider, consisting of a single resonant circuit including a nonlinear inductor with a core of amorphous magnetic material, and a capacitance connected in series with an inductor to define a resonant circuit that detects electromagnetic radiation at a first predetermined frequency and responds to detection by transmitting electromagnetic radiation at a second frequency that is a sub-harmonic of the first frequency. The resonant circuit may further include a second inductor connected in series with the nonlinear inductor and the capacitance to define the resonant circuit. The core of the nonlinear inductor includes an elongated thin flat ribbon of amorphous magnetic material. While this system is less expensive and less complex than the system of above U.S. Pat. No. 4,481,428, this patent's improvements over prior art, does not disclose or implement newest or most efficient and effective technology, nor does this invention appear to be readily portable, nor does this invention appear to be conducive for use in clandestine surveillance operations.

U.S. Pat. No. 4,742,357 to Rackley discloses a stolen object location system having a base station, a location network, and an object unit which is associated with the object to be located. The invention includes a microprocessor controlled (INTEL 8086) transponder primarily conceived for use in vehicles. The transponder is activated from a base station, upon being notified that the object has been stolen. Positioning is by means of any of or any combination of the four different methods DRT, DST, DDM and LORAN. The system initiates transmission of an alarm message if the unit is losing communication with the base station, whereby other similar units may relay such an alarm message. The system does not appear to be intended to be portable, nor is the system conducive for use in clandestine surveillance operations.

U.S. Pat. No. 5,032,845 discloses a microprocessor-controlled transponder having programs in external PROMs, intended for vehicles. This transponder contains many sensors directly intended for vehicles such as e.g. ignition coil, door contacts etc. It may, if required activate main headlights, horn, ignition system. The transponder is provided with a miniaturized remote key pad. A four digit code must be given before the car is started in order not to have the transponder by itself call for attention. Positioning is made by the system LORAN-C (100 kHz). Voltage supply +12 volts is effected from the electric system of the vehicle.

None of the above patents offer a system which is applicable for simple surveillance of objects which are easily being moved out of a predefined surveillance area, nor do they appear conducive for use in clandestine surveillance operations.

U.S. Pat. No. 5,917,423 to Duvall teaches a transponder apparatus for use in identifying the presence of an object such as a vehicle interrogated by broadcasted radio activation command signals on a predetermined RF carrier carrying encoded information unique to that object and its transponder. The apparatus disclosed has means for receiving commands and decoding signals. The device as disclosed allows police to activate a transponder system to assist in the radiolocation of a stolen vehicle. This patent appears to be utilitarian for certain radiolocation applications but does not contain the "non-detectability" features of the present invention, which prevents unauthorized receivers from detecting the triggered transponder response. This patent and its' product would appear to have no special capabilities for reducing multi-path interference typical of cluttered environments. This patent is also silent of the topic of equipment configurations suited for surreptitious tracking which are adapted to reduce or eliminate the probability of detection by sophisticated conventional radiolocation equipment.

U.S. Pat. No. 6,054,950 to Fontana teaches an ultra wideband (UWB) or short-pulse transmission system that enables precise tracking or geolocation of a target over distances of several kilometers. The system as disclosed includes a set of N (where N>2) untethered UWB transceivers located at fixed positions, an untethered UWB receiver at the target, and a processor at the target for resolving time-of-flight measurement ambiguities of received pulses to determine precise geolocation by solving a set of equations according to time-of-flight measurements and surveyed positions of N−1 transceivers. To eliminate a clock distribution system, self-synchronizing of pulse timing is achieved by generating a start pulse at one of the untethered transceivers. Alternatively, a timing source may be provided by a GPS or other timing generator at the transceivers in order to synchronize emissions of their pulses. This patent is also silent on the topic of equipment configurations suited for surreptitious tracking to reduce or eliminate the probability of detection by sophisticated conventional receiver systems. This patent and the product it protects also do not address or resolve issues associated with multi-path interference typical of cluttered environment.

U.S. Pat. No. 6,236,836 to Westman discloses a transponder system which presents a light weight portable or mobile system for localization of movable objects, e.g., for surveillance of valuable transports and the like. The transponder contains a receiver of paging type, a decoder, a logic unit, a transmitter portion, a built-in antenna and power supply. The system is controllable by an existing tested radio system for paging. Control information sent to the transponder includes a number of symbols defining a certain basic function for the built-in marker transmitter and symbols which constitute control code and control data for the specific function. Consequently at least the frequency, transmit power and transmitting sequences of the marker transmitter are controllable. The invention offers a flexible portable system with small dimensions for marking of objects, e.g. transport bags for valuables, larger valuables, persons/children or certain types of domestic animals. The invention transfers control information via an existing nationwide covering radio system, e.g. a paging system, whereby the position of the transponder does not have to be known at the enabling moment or after an occasion with activation. The transponder is localized by a direction-finding system by means of radio signals being transmitted by the transponder. However, this system would appear to be relatively easy to detect by sophisticated "sweep" equipment, even if it were not seen with the naked eye by placement in an inconspicuous place, e.g., on the underside of a vehicle by magnetic attachment means.

U.S. Pat. No. 6,512,455 discloses a system and method for monitoring assets, objects, people, animals, etc., using impulse radio. The system and method for monitoring can vary the duty cycles of the impulse radio transmitters, by manual or automated means, to accommodate varying requirements.

Published application 20030090435 to Santhoffet al. discloses a UWB (ultra-wideband) antenna array. One embodiment of the disclosed invention uses a multi-element antenna for UWB beam forming and also for time-of-arrival vector processing to resolve multi-path problems in an UWB communication system. Another embodiment of the present invention recovers the energy contained in the multi-path reflections to increase signal-to-noise ratios of received UWB pulses. This is a patent and product that provides a potential antenna configuration which could theoretically reduce multi-path interference and improve antenna gain, but this patent is silent on the topic of equipment to support clandestine tracking and surveillance operations at all, as does the present invention.

Published Patent Application 20040057500 to Balachandran et al. discloses methods and systems for generating a Variable Spacing Pulse Position Modulated (VSPPM) signal for transmission across an ultra-wideband communications channel. A time hopping code sequence consisting of N.sub.c elements with a one-to-one chip association is applied to each symbol so that the position of each pulse is shifted to the appropriate time slot that corresponds to the time hopping code value. While this patent is useful in helping hide the signal and reduce its' susceptibility to interception, it does not provide a system, method, and apparatus suited for clandestine tracking and surveillance operations such as the present invention.

NECESSITY OF THE INVENTION

What is needed in the art, is an ultra-low power, ultra-wideband (UWB) transponder which is effectively physically "disguised" such that it cannot be readily physically noticed or recognized upon routine visual inspection, and "stealthy" enough that it cannot be easily detected when operating, by conventional or sophisticated radio-frequency detection ("electronic sweep") equipment and/or signal triangulation equipment. What is needed in the art, is a device that is conducive for use in clandestine surveillance operations.

OBJECTS OF THE INVENTION

It is a primary object of the invention to provide an ultra low power, ultra wideband (UWB) transceiver device comprising a "stealth transponder" which has "disguised" and nondescript electronic packaging, which is especially suited for use in clandestine surveillance operations. It is another object of the invention to provide a "stealth transponder" operational measure, which is highly portable and not detectable by most of the sophisticated radio detection technology available today which is routinely used as countermeasures to such radiolocation-oriented surveillance measures.

Another object of this invention is to avoid the effect of multi-path interference and determine the physical position of the device with greater potential accuracy than can be achieved using GPS or other technologies. This is especially important if the target of the investigation is an armed terrorist, for example, who must be precisely located or is hiding within a densely populated urban environment.

Another object is to avoid the effects of multi-path interference that is presented by doors, walls and other obstacles. Multi-path interference occurs when signals are reflected off surfaces, such as building walls or rocky terrain, resulting in the receipt of the same signal from multiple paths. This invention would time-gate the receiver so that it would ignore signals, such as multi-path reflections, that are received outside of the prescribed time interval. Thus, the device would continue to be trackable even after entering buildings or passing through complex urban environments.

SUMMARY OF THE INVENTION

The electronic components of the transponder apparatus of the present invention generate and transmit ultra-low-power signal transmissions, including optionally, a pulsed spread spectrum signal. The invention is also organized to broadcast its' pulsed transmissions only after being first enabled and actuated by an externally-generated "enabling and actuating" signal. Basically, the invention allows a tracker (e.g., police, detective, surveillance agent or agency, etc.) to clandestinely and securely track a suspected criminal or terrorist. This is possible, because the transponder apparatus is virtually undetectable when it is not operating and remains virtually undetectable even by sophisticated equipment even when it is operating. This is particularly so, when the invention is configured to only operate at predefined time periods and/or at random time periods.

Ultra-wide band technology uses impulse-response in the time domain instead of oscillation in the frequency domain to produce time-invariant microwaves. In lieu of sinusoidal waves, UWB transmitters emit precisely timed pulses that appear across a wide frequency spectrum. The technology behind Ultra Wide Band has been well-known since the early 1970's when Ross of Sperry Rand Corporation was awarded the first UWB or "impulse" patent (Ross 1973).

Ultra-wideband technology has several unique and attractive features, notably, immunity to multi-path interference, jamming, and intentional and unintentional interference; low probability of intercept; and enhanced signal penetration capabilities.

As is well known in the literature, UWB can not only be detected at very low power, but also can pass though common obstacles such as garage doors. UWB is more resistant to multi-path interference, such as interferences produced by electromagnetic wave reflections experienced in transmission environments where multiple walls, buildings and other signal reflection surfaces abound. Published application 20030090435 describes this approach. By triangulation methods adapted for ultra wideband, the position of the transponder can theoretically be determined within one centimeter, but in practice can be determined to within 30 cm (about one foot).

Recently, single-chip versions of UWB transceivers have been produced that are suitable in terms of size and power to fit the small and thin form factors required for this invention. These small chips or chip sets can be embedded into miniature structures such as bolt heads or credit cards, thereby reducing the likelihood of physical detection.

In its preferred embodiment, the electronic tracking and surveillance apparatus of the present invention is embedded into a commonly seen, "unsuspicious appearing" device. Target apparatuses include objects such as a credit card, cell phone, bolt-head, a gas-cap, a wheel-balancing lug, or other nondescript truck, auto, or other intrinsic (or add-on) part or object having a form-factor that visibly but deceptively appears to be a normal part (or add-on) of the target environment.

In operation, the tracking and surveillance apparatus either receives external signals continuously and/or at periodic intervals so that it is always (and/or at prescheduled times) ready to acknowledge an authenticated tracking signal (usually from the tracking and surveillance apparatus owner and/or operator). The tracking and surveillance apparatus endeavors to decrypt all received messages to determine if they originate from an authorized surveillance governor and/or surveillance tracker (i.e., a base station and/or other source of an "external enabling and actuating signal"). The tracking and surveillance apparatus does not respond with an acknowledgement or emit a "trackable" signal unless—and until after—the received external enabling and actuating signal is found to contain an "authenticator" message that contains a proper authenticator that was encrypted by an authorized key and which corresponds to the current time, for example. In this way, the device will not respond to an unauthorized tracking signal used to detect its presence, e.g., which is emitted from a "bug detector". Essentially, a challenge/response interactive dialogue can be established in advance, by the surveillance governor or operator. Once the electronic tracking and surveillance apparatus of the present invention receives and validates the source of the actuating and enabling signal, its response signal will contain information uniquely identifying the transponder unit transmitting the information using "Variable Spacing Pulse Position Modulation (VSPPM)", e.g. The pulse position spacing is determined by pseudo random sequence that is controlled by the interrogating party. The VSPPM method of modulating the data can make it very difficult to detect by unauthorized parties unless the pseudorandom pulse spacing is known. This is because the VSPPM is needed to collect and average the samples needed to detect a series of related transmission pulses. In conclusion, even if an unauthorized party were to observe the electronic signal of the device while it is being legitimately interrogated by an authorized party, this information would be difficult for them to detect, accumulate, and use. This technique is well known in the art and appears in Published Patent Application 20040057500.

It is important to note, that the microprocessor of the electronic tracking and surveillance apparatus is typically programmed with one or more algorithms for generating pulsed ultra wideband transmissions in accordance with a predetermined transmission periodicity and/or predetermined transmission frequency or frequencies. In addition to relying on the fact that the electronic tracking and surveillance apparatus of the present invention transmits ultra low power signals which are not ordinarily easy to detect, the apparatus can be configured and implemented to only transmit when multiple external events occur (successfully completed challenge/response interactive dialogues, for example) and when the predetermined time(s) to periodically transmit coincides therewith (except when continuous tracking service is implemented).

FIGURES

1 Module with processor/transceiver chip and antenna loop
2 Bolt with hollow head and module inserted, plastic filled
3 Isometric view of what looks like an ordinary bolt

LEGENDS

100 Module with antenna and processor/transceiver
102 Processor/transceiver
104 Antenna
106 Bolt with hollow head
108 Metallic-looking plastic plug that passes RF signals

I claim:

1. An electronic tracking and surveillance apparatus, comprising:

an extremely reduced-sized form-factor electronics package externally disguised as, but not limited to, one of a protruding bolt head, a gas tank cap, and a wheel balancing lug; and transceiver electronics for transmitting pulsed ultra-wideband transmissions, including at least one circuit having at least one microprocessor, an antenna, and a power source, wherein said apparatus is not enabled, operable, and transmitting unless it has been first enabled and actuated by means of an externally transmitted enabling and actuating signal, wherein said external enabling and actuating signal represents and further comprises an initiation of a challenge/response dialogue adapted to enable and actuate operation of said tracking and surveillance apparatus.

2. A method for transmitting surveillance tracking signals, comprising the steps of:

implementing an electronic tracking and surveillance apparatus with a disguised, small form factor electronics package including transceiver electronics for transmitting pulsed ultra wideband transmissions;

programming at least one spread spectrum signal transmission algorithm into memory of at least one microprocessor disposed within said electronic tracking and surveillance apparatus;

placing said electronic tracking and surveillance apparatus into a target object to be tracked;

generating in an external signal source at least one external enabling signal for enabling and actuating transmissions by said electronic tracking and surveillance apparatus;

verifying in said electronic tracking and surveillance apparatus with a challenge/response dialogue the source of said at least one external enabling signal;

transmitting said pulsed ultra wideband transmissions after confirming the validity and identity of the source of said at least one external enabling signal; and receiving in a base station at least one signal from said electronic tracking and surveillance apparatus.

3. The method of claim 2, wherein the periodicity of said step of generating and transmitting at least one external enabling signal is effectuated only during at least one predetermined time period.

* * * * *